US007389554B1

(12) United States Patent
Rose

(10) Patent No.: US 7,389,554 B1
(45) Date of Patent: Jun. 24, 2008

(54) AIR SLEEP SYSTEM WITH DUAL ELEVATING AIR POSTURIZING SLEEP SURFACES

(75) Inventor: Eric S. Rose, Easley, SC (US)

(73) Assignee: Comfortaire Corporation, Greenville, SC (US)

( * ) Notice: Subject to any disclaimer, the term of this patent is extended or adjusted under 35 U.S.C. 154(b) by 80 days.

(21) Appl. No.: 11/173,543

(22) Filed: Jul. 1, 2005

Related U.S. Application Data

(63) Continuation-in-part of application No. 10/967,461, filed on Oct. 18, 2004, now abandoned, which is a continuation of application No. 10/389,173, filed on Mar. 14, 2003, now Pat. No. 6,804,848.

(51) Int. Cl.
*A47C 27/10* (2006.01)
*A61G 7/015* (2006.01)

(52) U.S. Cl. ..... 5/710; 5/617

(58) Field of Classification Search ..... 5/706, 5/710, 713, 617
See application file for complete search history.

(56) References Cited

U.S. PATENT DOCUMENTS 3,646,621 A * 3/1972 Fragas ..... 5/617
3,978,530 A * 9/1976 Amarantos ..... 5/615
5,642,546 A 7/1997 Shoenhair
6,115,861 A 9/2000 Reeder et al.
6,212,718 B1 4/2001 Stolpmann et al.
6,317,912 B1 11/2001 Graebe et al.
6,378,152 B1 4/2002 Washburn et al.
6,430,763 B2 8/2002 Kosumsuppamala et al.
6,460,209 B1 10/2002 Reeder et al.

* cited by examiner

*Primary Examiner*—Alexander Grosz
(74) *Attorney, Agent, or Firm*—McNair Law Firm, PA; Cort Flint

(57) ABSTRACT

A high-profile air sleep system having a pair of air posturizing sleep surfaces which may be individually inclined and air adjusted comprises an air posturing module having an outer module mattress case. A first case section extends medially along a length of said mattress case to define a first movable posturing section, and a second case section extends along a length of said mattress case to define a second movable posturing section. A third fixed module case section is included in said mattress case below the first and second posturing sections. A first air chamber is carried in the first and third case sections, and a second air chamber is carried in the second and third module sections to provide first and second posturizing module sections with individually elevatable posturizing sleep surfaces.

32 Claims, 8 Drawing Sheets

AIR SLEEP SYSTEM WITH DUAL ELEVATING AIR POSTURIZING SLEEP SURFACES

CROSS REFERENCE TO RELATED APPLICATION

This application is a continuation-in-part of application Ser. No. 10/967,461, filed on Oct. 18, 2004, now abandoned; which is a continuation of application Ser. No. 10/389,173, filed on Mar. 14, 2003, issued on Oct. 19, 2004, as U.S. Pat. No. 6,804,848 B1, on which priority is claimed and which disclosures are incorporated by reference.

BACKGROUND OF THE INVENTION

This invention is directed to air support sleep systems, and particularly to a multi-compartment high-profile mattress having a base support module and an upper air posturizing module wherein a pair of individually elevatable air posturizing module sections provide posturizing support in a variety of sleeping and inclined positions.

In the past, air sleep systems have been provided in which one or more air chambers is enclosed in a single module with foam blocks constituting the sidewalls of the unit to prevent sagging such as shown in U.S. Pat. No. 5,642,546. A thin foam overlay is usually placed over the air chambers. While providing a good sleep surface, complete edge-to-edge adjustability using air is not provided because the foam block sidewalls usually occupy about a six inch space on the sides, or about 12" at overall width. The construction normally results in a mattress about 6" to 8" high when the foam overlay is placed over the air chambers. In an attempt to meet the increasing popularity of thicker, high-profile mattresses, additional layers of foam have been stacked upon the air chambers within the mattress casing. However, this has resulted in what is known as "hammocking." Hammocking occurs when the cushioning overly deflates or compresses so that the body assumes a hammock position which strains the lower back. Because the air chambers are now further below the foam layers, the posturizing affect of the adjustable air chambers is less, becoming negligible. In addition, the taller sides of the high-profile mattress casing results in the sides of the mattress sagging and bowing out. The foam and other mattress layers are no longer encased in position and become wobbly resulting in an overall unstable mattress support. The softer and more plush foam cushioning above the air chambers eventually loses its resilience and ability to properly support the person. Posturizing, which is the support of the back in its proper position, has not been reliably achieved in the prior air sleep systems, particularly the high-profile system. Basically, the idea of posturizing is to remove all gaps between the person's body and the sleeping surface without hammocking. Therefore, the need to provide a high-profile mattress, i.e., one that is about 15" in height, using adjustable air chambers is a problem requiring much attention.

Examples of other prior air mattress structure include U.S. Pat. No. 6,378,152 B1 which shows a variable firmness mattress structure in a single module which includes a plurality of longitudinally spaced, transversely extending air bladders whose firmness may be selected individually. U.S. Pat. No. 6,460,209 B1 discloses an air mattress structure wherein an inflatable bladder is positioned upon a plurality of longitudinally spaced foam blocks which are independently moveable relative to one another. U.S. Pat. No. 6,212,718 B1 discloses an air mattress structure which includes a plurality of inflatable air bladders tethered together. U.S. Pat. No. 6,430,763 B2 discloses an air mattress having an approved side bolster system.

Accordingly, an object of the present invention is to provide an air support sleep system wherein proper sleep and other posture support is provided using a pair of individually movable posturizing module sections.

Another object of the present invention is to provide an air posturing module and base module which may be used with a power base to incline the modules to provide an air posturing support surface for sleeping as well as reading, watching television, and the like.

Another object of the invention is to provide an air support sleep system having an overall high-profile design wherein an upper, low-profile air posturizing module is supported on an integral, lower mattress base module.

Another object of the present invention is to provide an air support sleep system having a multi-compartment mattress case which includes an upper low-profile fabric encasement and a lower base support encasement wherein an air posturizing assembly is enclosed in the upper encasement and a base foundation assembly enclosed in the lower fabric encasement to provide a high-profile mattress design.

Still another object of the present invention is to provide an air support sleep system which may be set up and taken down for transportation and storage having an upper mattress air posturizing module enclosed in an upper fabric encasement with two individually moveable module sections, and a lower mattress base module enclosed in a lower fabric encasement having two individually moveable base module sections corresponding to and supporting said posturizing module sections.

SUMMARY OF THE INVENTION

The above objectives are accomplished according to the present invention by providing an air support sleep system having an air posturizing sleep surface to provide proper sleep posture comprising an upper mattress air posturizing module having an adjustable air posturizing sleep surface. The module includes an air posturizing assembly having a pair of inflatable air chamber providing the adjustable air posturizing sleep surface, and a first mattress case encasing the air posturizing assembly. An access opening in the first mattress case provides access to the interior of the mattress case for installation and removal of the air chamber and for servicing the air chamber. A first releasable closure for the access opening provides opening and closing of the access opening. A mattress base module supports the mattress air posturizing module and includes a resilient foam foundation assembly for providing mattress cushioning. A second mattress case encases the foam foundation assembly. The mattress air posturizing module and the mattress base module provide a high-profile mattress design with an upper adjustable air posturizing sleep surface.

The posturizing module includes an adjustable air posturizing sleep surface; and first and second individually adjustable air chambers arranged side-by-side. A first individually elevatable module section includes a length of the first air chamber; and a second individually elevatable module section includes a length of the second air chamber. A third non-elevatable module section includes a length of each of the first and second air chambers. An operator is provided for moving the first and second module sections individually to a desired elevated position whereby an air posturizing sleep surface is provided having first and second upper individually elevatable and air adjustable posturizing sections, and a non-elevatable, air adjustable lower posturizing surface.

In another aspect, a mattress base module may be provided for supporting the air posturizing module which includes a resilient foam foundation assembly for providing mattress cushioning. The module includes a medial split along a length thereof defining individually elevatable first and second base module sections supporting the first and second module sections of the posturizing module, respectively. The operation raises and lowers the first and second module sections of the posturizing module and the base module individually.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1A:
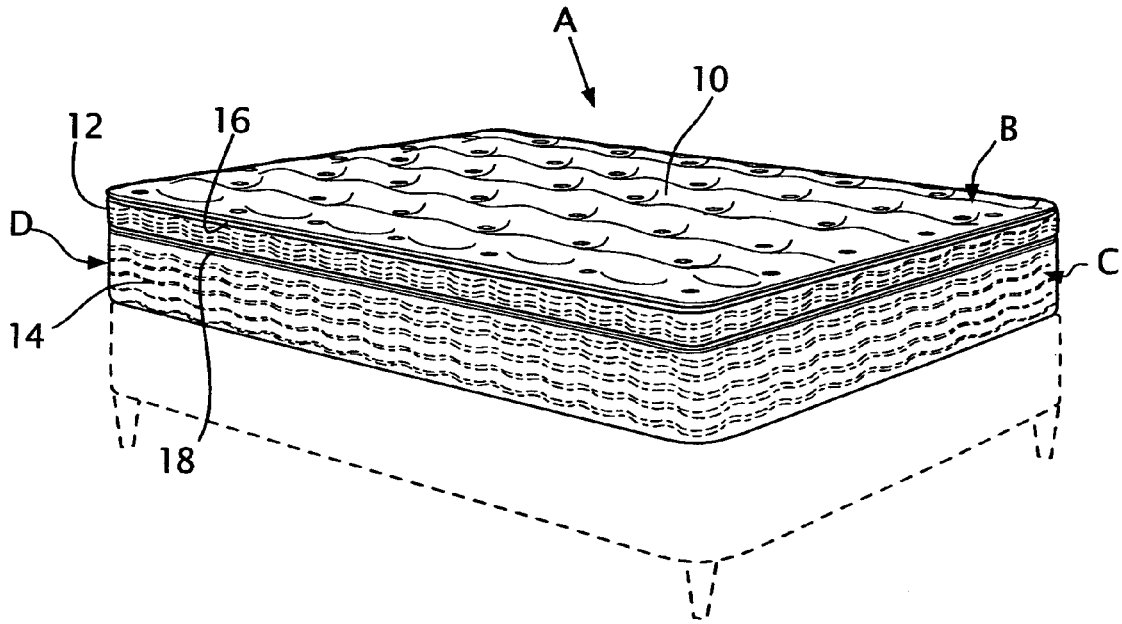
FIG. 1A is a perspective view illustrating a multi-compartment mattress having an upper, low-profile module with an air posturizing sleep surface.

Referring now to the drawings, the invention will now be described in more detail.

Figure 1B:
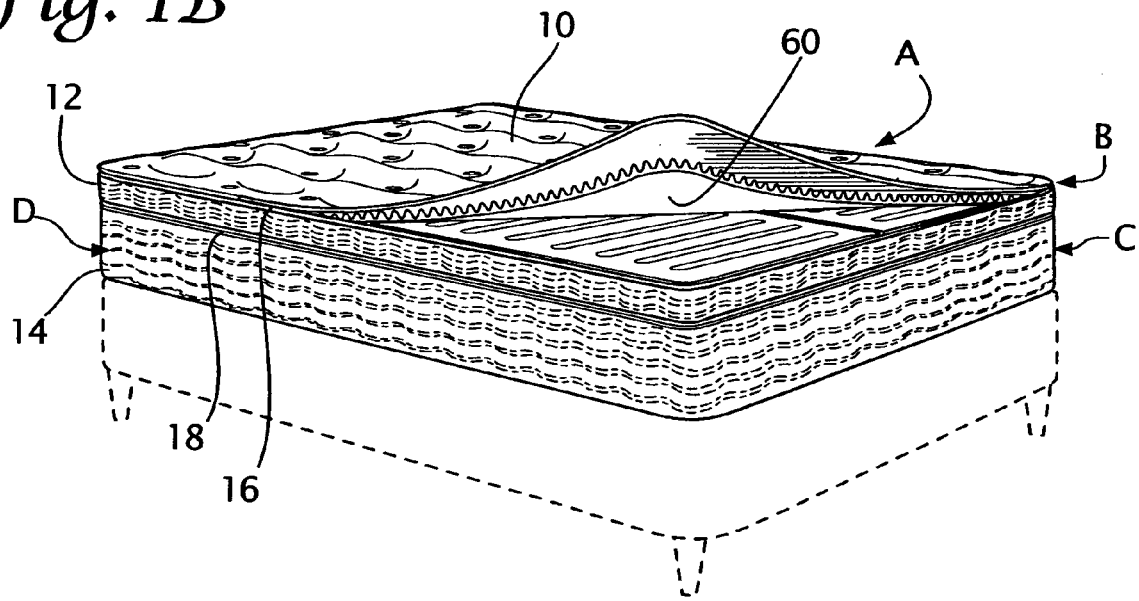
FIG. 1B is a perspective view of the mattress of FIG. 1A with an access opening of the air posturizing module for installation and removal of the air posturizing assembly.

As can best be seen in FIG. 1, an air support sleep system is illustrated, designated generally as A, having an upper air posturizing module, designated generally as B, and a lower mattress base module, designated generally as C. The air posturizing module provides an air posturizing sleep surface 10 which can be adjusted to provide a correct sleeping posture. A mattress case, designated generally as D, includes a upper self-contained fabric encasement 12 and a lower self-contained fabric encasement 14. There is a first releasable closure 16 for fabric encasement 12, and a second releasable enclosure 18 for fabric encasement 14. The upper and lower fabric encasements are made integral to form a unitary mattress case, as will be more fully explained below.

Figure 4:
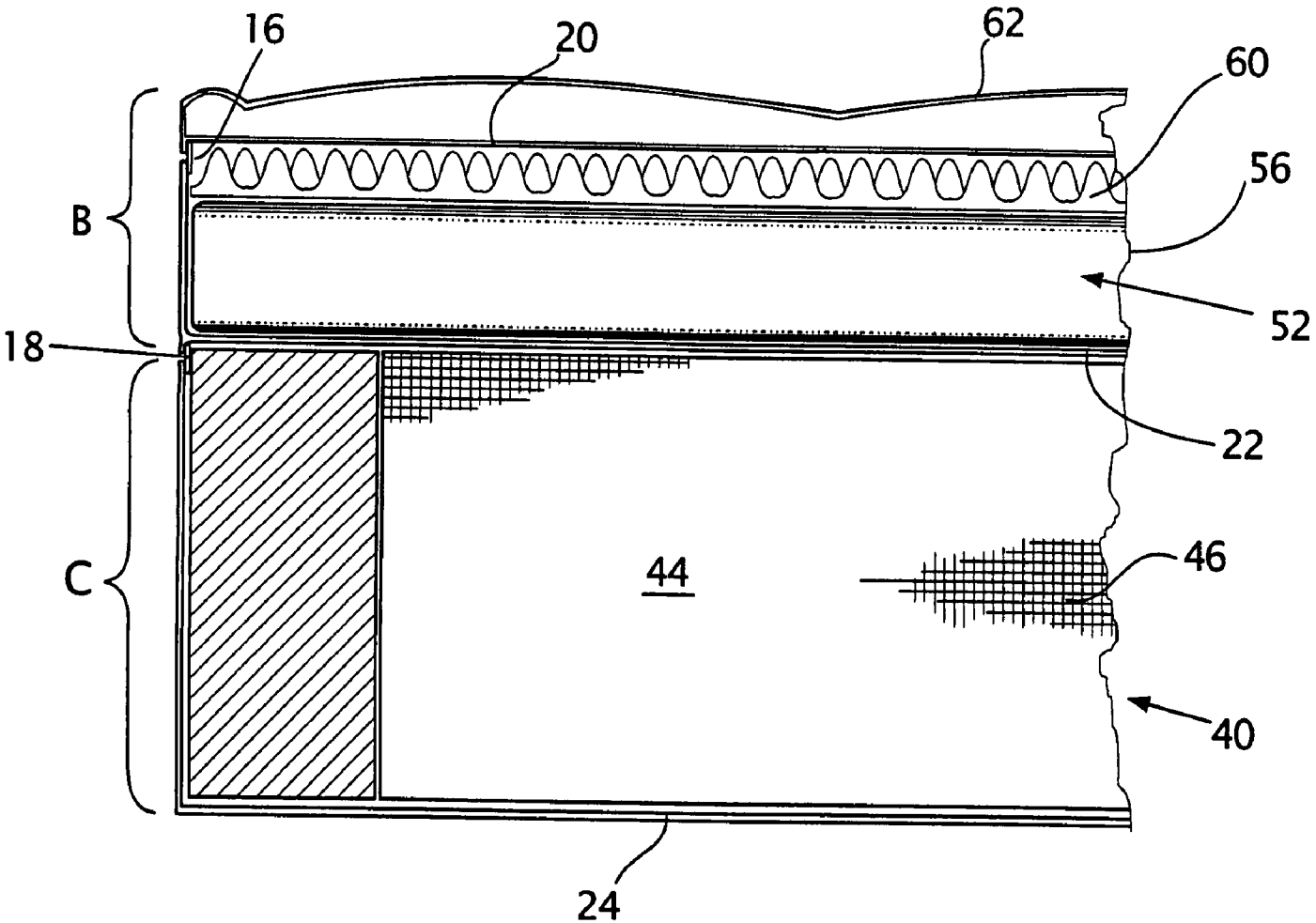
FIG. 4 is a sectional view taken along line 4-4 of FIG. 2.

As can best be seen in FIG. 4, mattress case D includes a top fabric cover layer 20, a middle fabric cover layer 22, and a bottom fabric cover layer 24. Top cover layer 20 is connected to middle cover layer 22 by means of first releasable closure 16 connecting middle layer 22 and peripheral fabric sidewall 28. Middle layer 22 is connected to bottom cover layer 24 by means of peripheral fabric sidewall 30 and second releasable closure 18. It is noted that middle cover layer 22 forms a bottom cover layer for upper mattress module B and a top cover layer for lower mattress module C.

Figure 2:
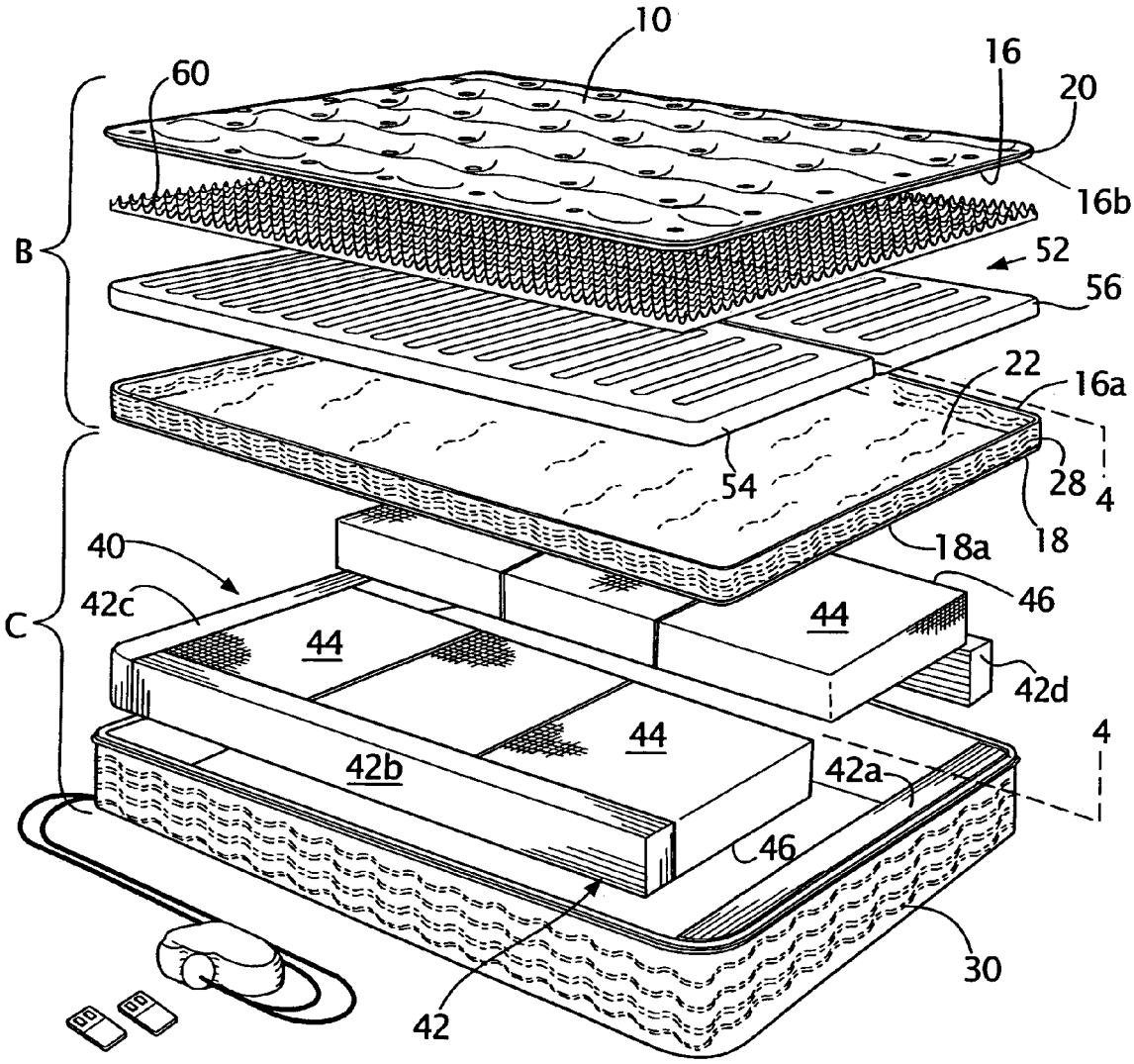
FIG. 2 is a perspective view with parts separated illustrating a multi-compartment mattress having a low-profile air posturizing module and an mattress base module supporting the air posturizing module.
Figure 3:
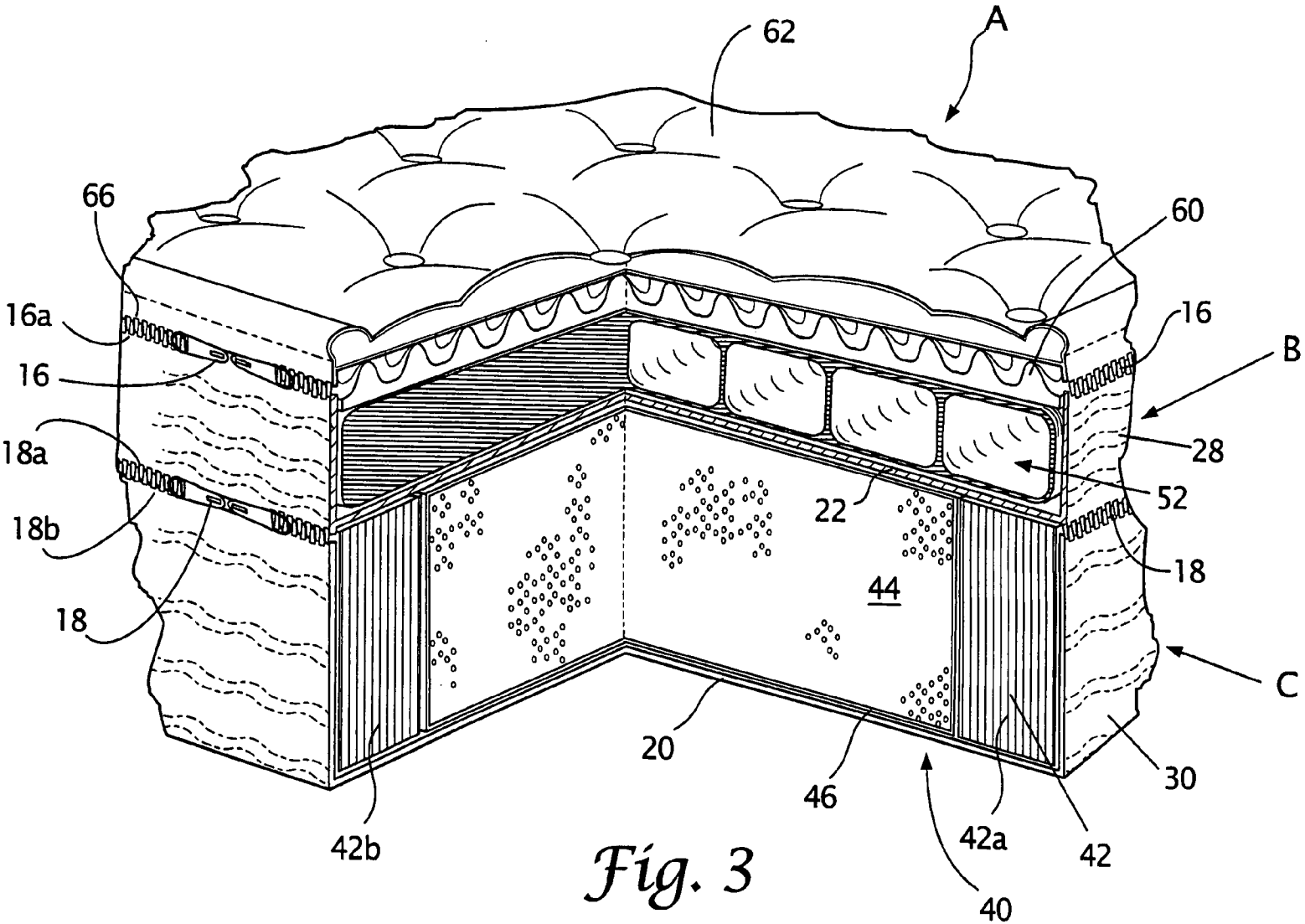
FIG. 3 is a sectional view taken along a corner of the mattress of FIG. 1A.

As can best be seen in FIGS. 2 and 3, a resilient foundation assembly, designated generally as 40, is illustrated which includes a peripheral edge support wall 42 in the form of 4 rectangular bolsters 42*a*-42*d* around the inner periphery of encasement sidewall 28. Inside the peripheral edge support wall 42 is included a plurality of foam blocks 44 encased in a fabric cover 46. In the illustrated embodiment there are 6 blocks 44. The foam blocks may be any suitable resilient foam such as Omalon, manufactured by The Carpenter Company of Hickory, N.C. The fabric cover around the foam blocks prevent them from sticking which would alter the support characteristics of the support base. The rectangular bolsters 42 are preferably a resilient, high-density foam, having a density, for example, of 1.6. The edge support wall provided by the foam bolsters provides a more rigid support than the foam blocks for edge support. Overlying the foam blocks is a top cover provided by middle fabric layer 22. Second releasable closure 18 includes a zipper closure having a first zipper part 18*a* carried around the periphery of fabric layer 22, and a second zipper part 18*b* formed around the outer periphery of encasement sidewall 30. In this way, an access opening in the form of an open top 40 can be had for the lower fabric encasement so that the edge wall and foam blocks may be inserted to provide the foundation assembly.

Referring now in more detail to upper mattress, low-profile air posturizing module B, it can be seen that the air posturizing assembly, designated generally as 52 is included in upper fabric encasement 12. In the illustrated embodiment, the air posturizing assembly includes a pair of air chambers 54 and 56 arranged side-by-side and resting on middle fabric cover layer 22 within encasement peripheral sidewall 28. The air chamber is 2" to 3" in height in order to prevent hammocking. The air chambers may be made from any suitable material such as a thermo plastic urethane. The air posturizing chambers combined with the comfort layer and lower foam supporting base provide an overall comfort and firm support surface. As can best be seen in FIG. 2, air chambers 54, 56 are dimensioned to fit tightly between the opposite sidewalls of encasement 12 so that they overly the entire area of foundation assembly composed of edgewall bolsters 42*a*-42*d*, and foam blocks 44. In this way, an air posturizing surface is provided completely over the entire surface area of the mattress, whereas in the prior mattresses, the air chambers were not allowed to overly the edge support wall. Next, overlying air chambers 54, 56 is a resilient pad 60. In the preferred embodiment, pad 60 is composed of a visco elastic foam providing a luxurious feel to the upper air posturizing sleep surface 10. Upper fabric cover layer 20 covers the resilient pad 60. A conventional "pillow top" pad 62 may be made integral with the top of cover layer 20. First releasable closure 16 is illustrated in the form of a zipper closure having a first zipper part 16*a* formed around the upper periphery of encasement wall 28, a second zipper part 16*b* carried around the edge of fabric layer 20. In this manner, with the zipper zipped all the way around the encasement wall and upper cover, a snug tight fit of air posturizing assembly 52 within the low-profile module B is provided. With the low-profile module B secured to the mattress base support C, an integral mattress structure is provided wherein shifting and sagging of the compartments is reduced, if not eliminated. Upper air posturizing sleep surface 10 may be selected to provide the correct posture by adjusting the air in the air chambers immediately below the sleep surface. In this manner, the adjustment of the air chamber is felt immediately upon the posture, rather than through thick layers of foam, as in the prior art. Moreover, a cushioned and firm support of the air posturizing module is provided by the zipper closures, an overall high-profile mattress unit is provided.

Thus, it can be seen that a highly advantageous construction can be had achieving the objectives of the invention by providing a high-profile air sleep system having a low-profile air module which provides an adjustable posturizing surface on top of a base support module comprised of foam. This minimizes hammocking. The base module can be provided in a desired height profile so that the overall height combination of the low-profile module and the base support module results in a high-profile mattress design in keeping with modern trends. A comfort layer is overlaid on the air chambers for additional comfort. The upper low-profile air module may also be provided with a quilted top for additional comfort. Originally it was thought one had to have firmness in the sleeping support surface, however, now one can actually have a plush sleeping surface and still have low back support. The combination of these two elements is achieved according to the invention, together with sleeping surface comfort and support.

Referring now to FIGS. 5 through 8, another embodiment of an air sleep system is illustrated, designated generally as A', wherein a pair of air posturing sleep surfaces 51*a* and 51*b* are provided having a pair of individually moveable posturing sections. The air sleep system includes an upper air posturizing module B' having an adjustable air posturizing surface 10'. Module B' includes an air posturizing assembly 52' having first and second individually adjustable air chambers 54, 56 arranged side-by side. At 65, posturizing module B' is split to define a first individually moveable posturing section 64*a* and a second individually moveable posturizing section 64*b*. First moveable posturizing section 64*a* includes first air chamber 54, and second moveable posturizing section 64*b* includes second air chamber 56. A first mattress case 12' encases the air posturizing assembly. A base module C' supports air posturizing module B', and includes a foam foundation assembly 40' for providing mattress cushioning. First and second individually moveable base sections 66*a* and 66*b* support and correspond to first and second posturizing sections 64*a* and 64*b*. A second mattress case 14' encases foam foundation assembly 40'.

An operator, generally designated as E, is provided for raising and lowering first and second posturizing sections 64*a*, 64*b*, and said first and second base sections 66*a*, 66*b* individually, to desired inclined positions, and may include conventional power base units 70 and 72. Typically, such units include an electric drive arrangement, as can best be seen in FIG. 8, comprising a motor 74, and a screw drive 76, and linkage arrangement 78 for raising the modules individually. For this purpose, individual remote controls 80 may be provided. A suitable power base is available from Leggett & Platt, Inc. of Carthage, Mo., as the Silhouette model.

Figure 6:
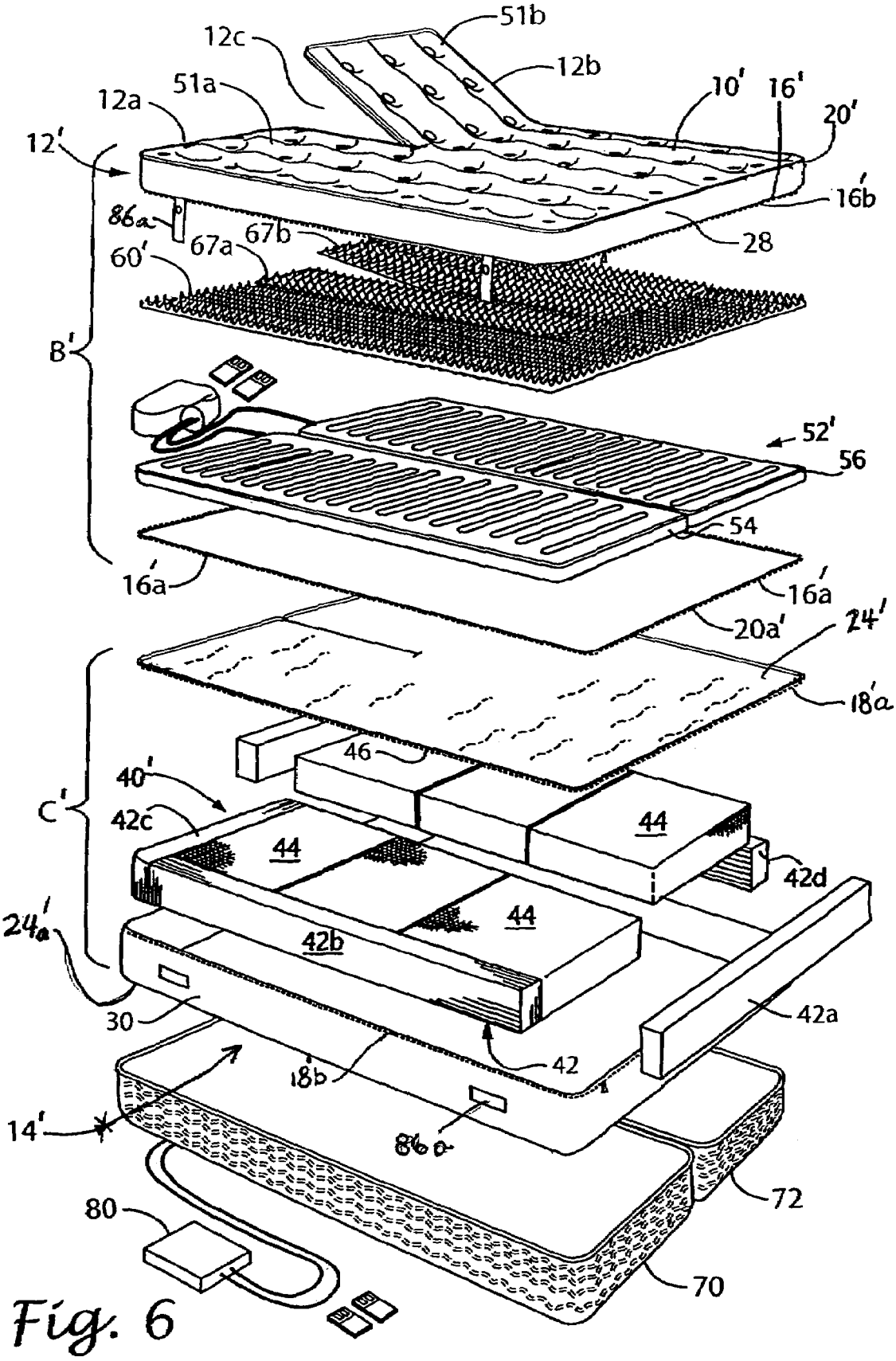
FIG. 6 is an exploded view illustrating the embodiment of FIG. 5A.

Preferably, posturizing module B' includes a split resilient overlay 60' disposed on top of air chambers 54, 56 generally coextending with the air chambers, as can best be seen in FIG. 6. Resilient overlay 60' has a first overlay section 67*a* and a second overlay section 67*b* individually moveable. First overlay section 67*a* corresponds to first moveable posturizing section 64*a*, and second overlay section 67*b* corresponds to second moveable posturizing section 64*b*.

A releasable fastener 84 is provided for securing posturizing and base modules B' and C' together so that the modules provide an integral mattress design with an upper adjustable air posturizing sleep surface 10'. Each releasable fastener 84 includes a first fastener part 86 carried by posturizing module B', and a second fastener part 88 carried by base module C'. Releasable fastener 84 is constructed and arranged such that posturizing and base modules may shift relative to one another while secured together during elevation to reduce bunching. For this purpose, first fastener part 86 may include an elongated band 86*a* having ends secured to base module C' creating a loose loop 86*b* in between. Second fastener part 88 may include an elongated strap 88*a* which loops around band 84*b* and fastens on itself, such as by using Velcro loop and hook material at 88*b*. Preferably, mattress base module C' has a height profile greater than a height profile of mattress air posturizing module B' to provide a high-profile design with a low-profile air posturizing module.

Figure 5A:
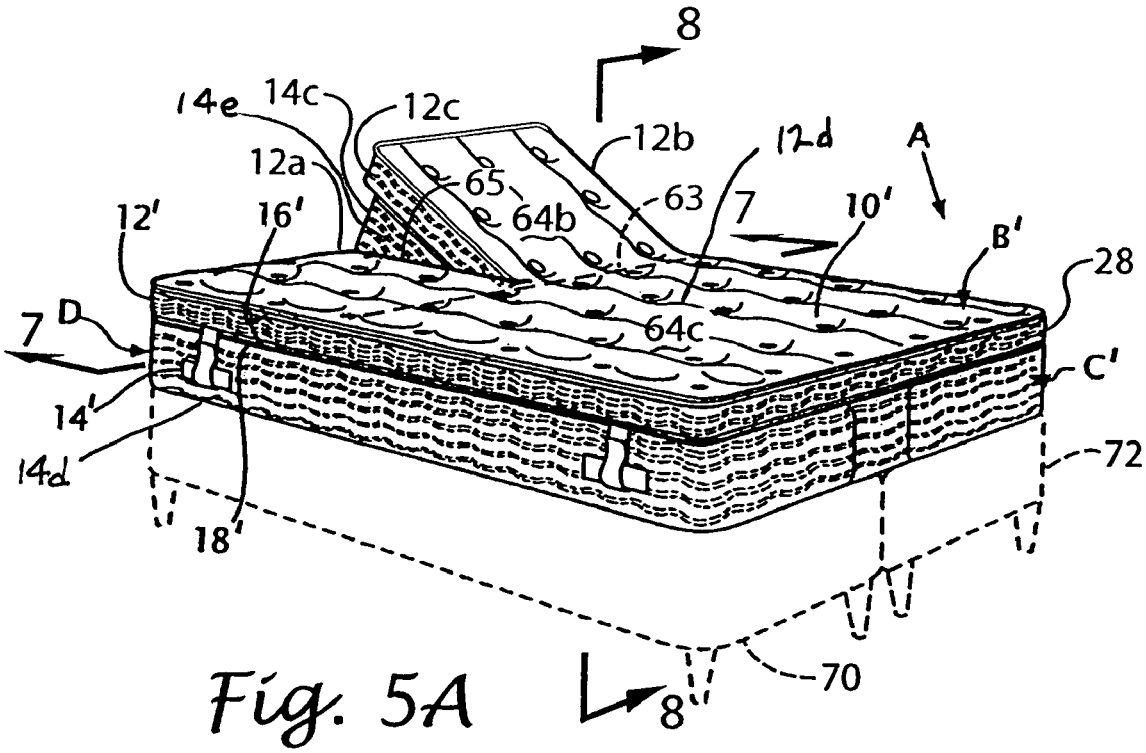
FIG. 5A is a perspective view of an embodiment of the invention wherein an air posturizing sleep surface is provided which includes a pair of individually adjustable inclined sleep surfaces.
Figure 5B:
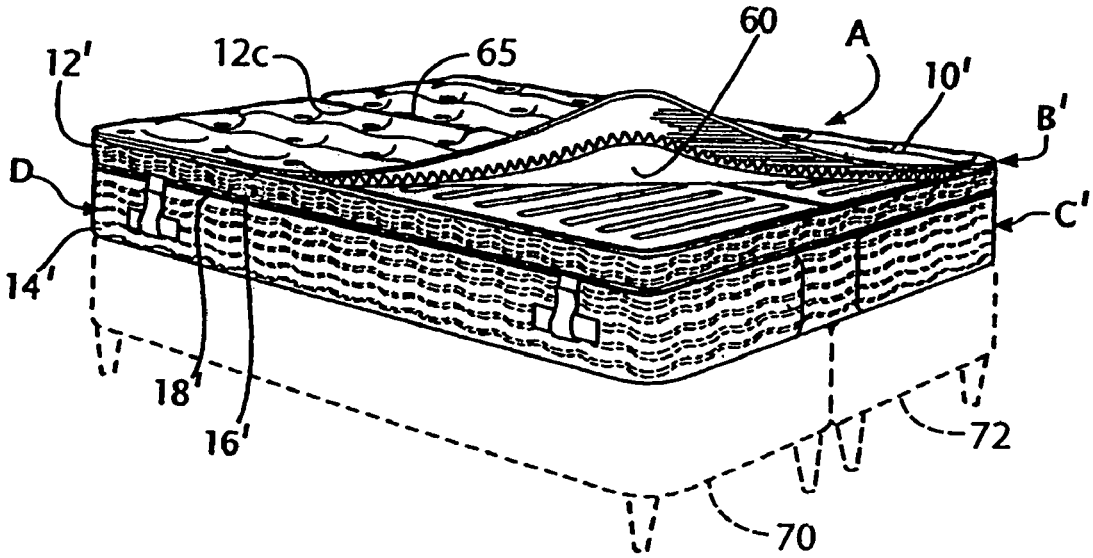
FIG. 5B is a perspective view of FIG. 5A with some parts separated.
Figure 7:
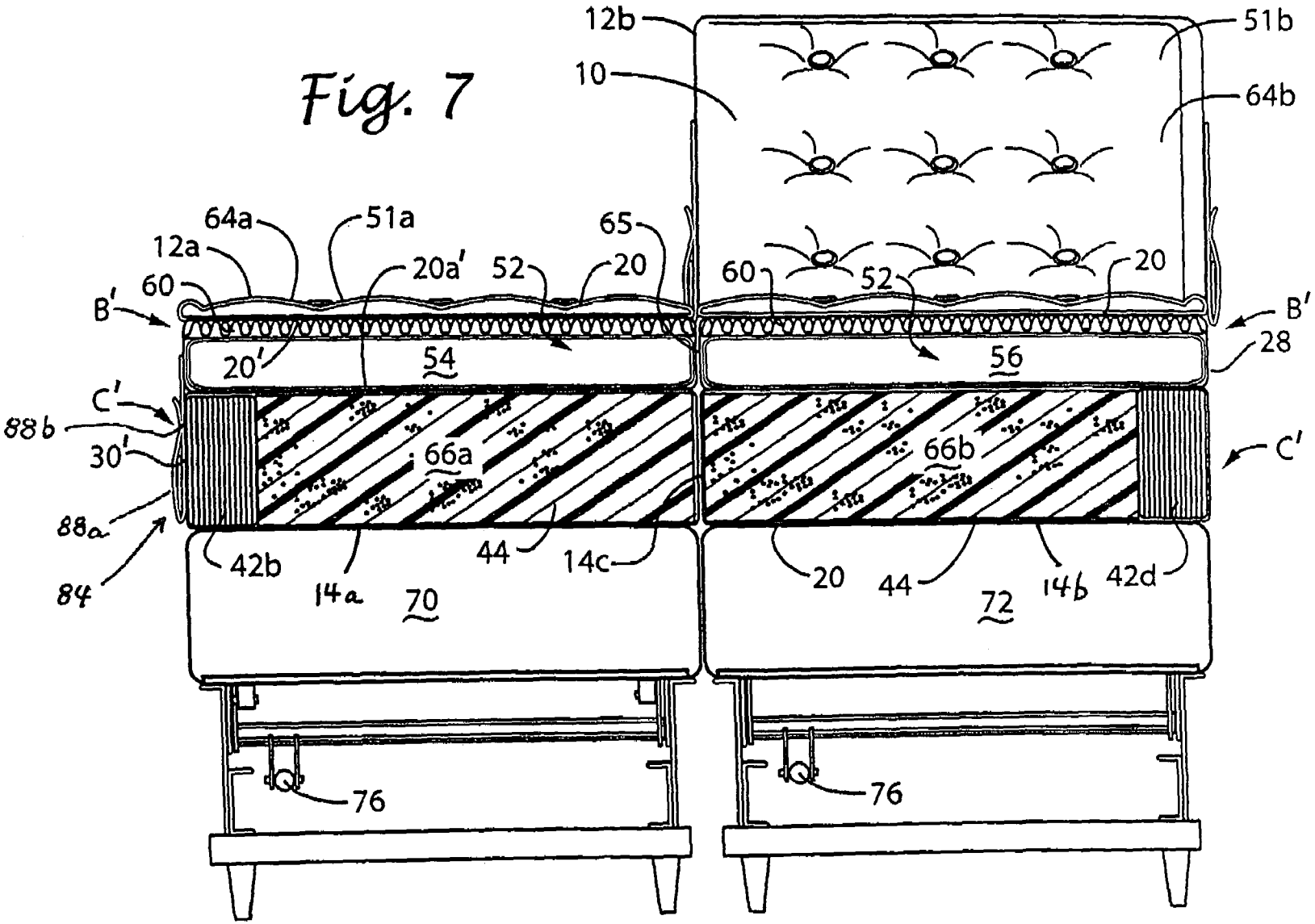
FIG. 7 is a sectional view taken along line 7-7 of FIG. 5A.
Figure 8:
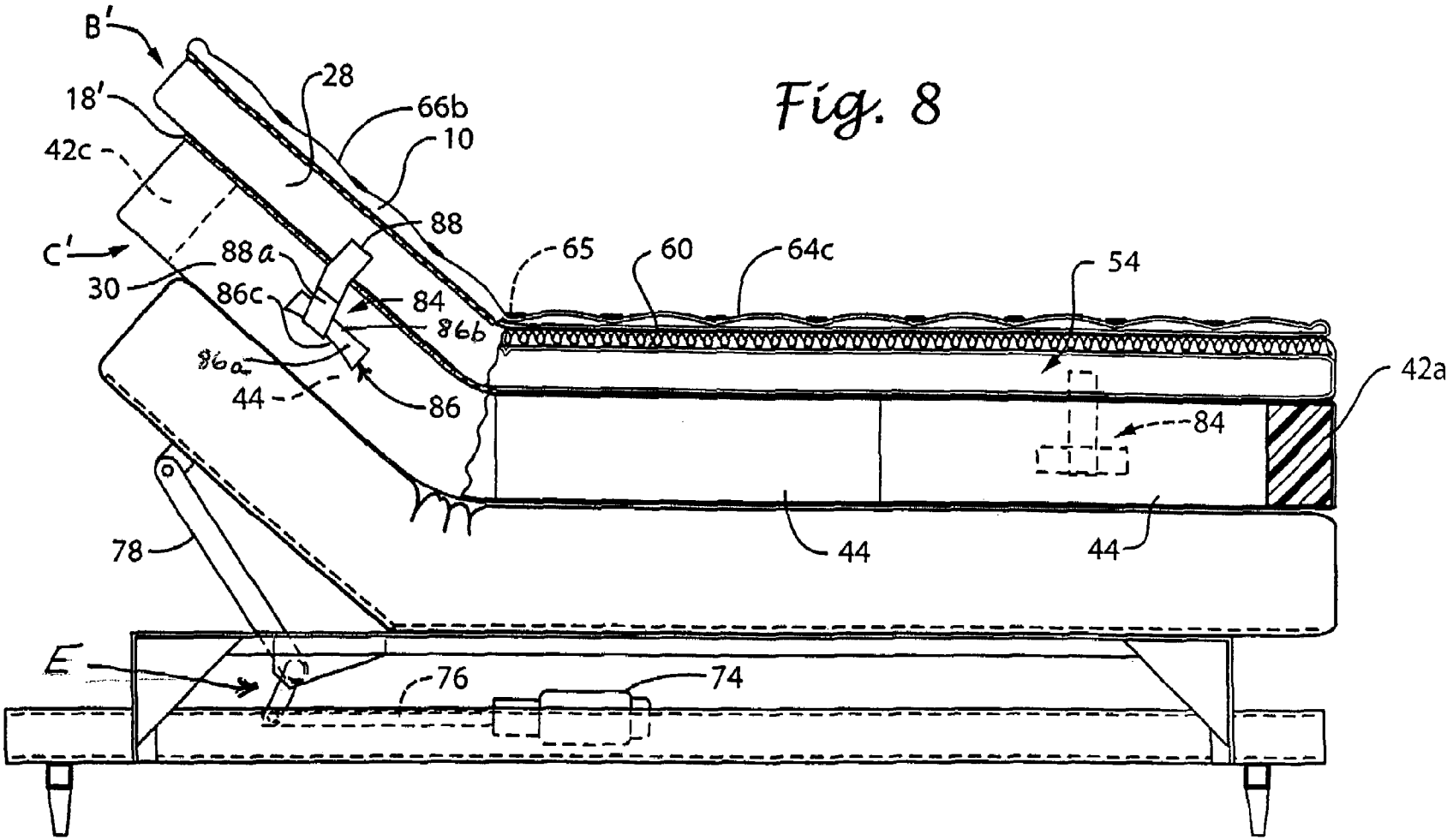
FIG. 8 is a sectional view taken along line 8-8 of FIG. 5A.

As can best be seen in FIGS. 5A, 7, and 8, first mattress case 12' includes first and second case sections 12*a* and 12*b*, defined by a medial case split 12*c*, in which first and second air chambers 54, 56 are received, respectively. Second mattress case 14' includes a matching medial split 14*c* defining first and second base case sections 14*a* and 14*b* in which separate parts of foundation assembly 40' are included equally. For this purpose, front bolster 42'*c* is split in half and a block 44 is included in each base section (FIG. 8). First module case section 12*a* encases a length of first air chamber 54, and second module case section 12*b* encases a length of second air chamber 56. A third module case section 12*d*, defined below the first and second sections, generally at line 63, commonly encases the remaining length of the first and second air chamber (FIG. 5A).

First mattress case 12' includes an access opening providing access to an interior of said mattress case for installation and removal of air chambers 54, 56, and for servicing the air chambers. A first releasable closure 16' is provided for opening and closing the access opening which zips from one side of slit 12*c* around to the other end of the slit (FIG. 5A). First mattress case 12' includes a peripheral sidewall 28 having spaced sidewalls integral with a pair of end walls. An upper posturizing cover layer 20', and a posturizing bottom cover layer 20'*a* are integral with the sidewall so that the air chambers and overlay are compactly encased to provide structural mattress stability to the air posturizing module whereby sidewall sagging is eliminated. Second mattress case 14' has a peripheral sidewall 30 with a split and includes a pair of spaced sidewalls and integral end walls. An upper base cover layer 24' and a bottom base cover layer 24'*a* are integral with the sidewalls so that the foundation assembly is encased to provide structural mattress stability to the base module whereby sidewall sagging is eliminated. Base module case 14' includes a medial split 14*c* along a length thereof defining individually elevatable first and second base case sections 14*d*, 14*e*.

Operator E raises and lowers first posturizing sections 64*a*, 66*a*, and second posturizing and base sections 64*b*, 66*b*, individually.

A second releasable closure 18' is provided for the mattress base module having a first closure part affixed around a periphery of top cover layer 24' of the first mattress case and a second closure part affixed around a periphery of sidewall 30 of the second mattress case. The releasable closure extends around the case from one side of the split to the other. Foundation assembly 40' includes a plurality of individual resilient foam blocks 44 positioned edge-to-edge and enclosed in said mattress case 14'. The foam blocks include individual fabric covers reducing sticking between contacting edges of the blocks in edge-to-edge relationship to maintain a uniform cushioned support surface. The foundation assembly also includes resilient generally rectangular bolsters 42 surrounding an outside periphery of the foundation blocks to provide foundation support around at least side edges of said mattress base module.

Accordingly, posturizing module B' includes a pair of posturing sections 64*a*, 64*b* which may be adjusted in their firmness by air and may be adjusted in their inclination by the power base. Posturizing module sections 64*a*, 64*b* include mattress case sections 12*a*, 12*b*, and upper portions of air chambers 54, 56 and, optionally, foam overlay sections 67*a*, 67*b*. An air adjustably stationary module section 64*a* is defined below line 63 of the posturizing module. Stationary section 64*c* commonly includes the lower, remaining portion of air chambers 54, 56 encased in mattress case section 12*c*. Corresponding base sections 66*a*, 66*b* encased in split mattress base case 14' support and cushion posturizing sections 64*a*, 64*b*. Thus, it can be seen that an advantageous construction can be had to provide for a pair of individually adjustable posturing sleep surfaces according to the invention.

While a preferred embodiment of the invention has been described using specific terms, such description is for illustrative purposes only, and it is to be understood that changes and variations may be made without departing from the spirit or scope of the following claims.

What is claimed is:

1. An air sleep system having an upper air posturizing sleep surface comprising:

(a) an upper mattress air posturizing module having a pair of adjustable air posturizing sleep surfaces, said module including;

first and second individually adjustable air chambers arranged side-by-side, a first moveable posturizing section which includes said first air chamber, a second moveable posturizing section which includes said second air chamber, a first mattress case encasing said air first and second air chambers, (b) a split mattress base module supporting said air posturizing module including;

first and second individually moveable base sections supporting and corresponding to said first and second posturing sections, a split second mattress case encasing said first and second base sections, and (c) an operator for raising and lowering said first and second posturing sections and said first and second base sections individually to desired inclined positions.

2. The system of claim 1 wherein said posturizing module includes a split resilient overlay disposed on top of said air chambers generally coextending with said air chambers, said resilient overlay having a first overlay section and a second overlay section individually moveable, said first overlay section corresponding to said first moveable posturizing section, and said second overlay section corresponding to said second moveable posturizing section.

3. The system of claim 1 including a releasable fastener for securing said first and second mattress cases together so that said air posturizing module and said base module provide an overall mattress design with a pair of upper adjustable air posturizing sleep surfaces.

4. The system of claim 1 wherein said mattress base module has a height profile greater than a height profile of said air posturizing module to provide a high-profile design with a low-profile air posturizing module having mattress stability.

5. The system of claim 1 wherein said first split mattress case includes a medial split defining first and second case sections in which said first and second air chambers are received.

6. The system of claim 5 wherein said second mattress case includes a medial split defining first and second case sections in which foam supports are received.

7. The system of claim 1 wherein said first split mattress case includes an access opening providing access to an interior of said mattress case for installation and removal of said air chambers and for servicing said air chambers, and a first releasable closure for said access opening for opening and closing said access opening.

8. The system of claim 7 wherein said first mattress case includes a peripheral sidewall, an upper posturizing cover and a posturizing bottom cover integral with said sidewall so that said air chambers and overlay are compactly encased to provide structural mattress stability to said air posturizing module whereby sidewall sagging is eliminated.

9. The system of claim 8 wherein said second mattress case includes a peripheral sidewall, an upper cover and a bottom cover integral with said sidewall so that said foundation assembly is encased to provide structural mattress stability to said base module whereby sidewall sagging is eliminated.

10. The system of claim 9 including a releasable fastener securing said air posturizing module and said base module together.

11. The system of claim 10 wherein said releasable fastener includes a first fastener part carried by said posturizing module and a second fastener part carried by said base module, said releasable fastener constructed and arranged such that said posturizing modules can shift relative to one another while secured together during elevation to reduce bunching.

12. The system of claim 9 including a second releasable closure for said base module having a first closure part affixed around a periphery of said upper cover of said second mattress case and a second closure part affixed around a periphery of said sidewall of said second mattress case.

13. The system of claim 1 including a foundation assembly having a plurality of individual resilient foam blocks positioned edge-to-edge and encased in said second mattress case.

14. The system of claim 13 wherein said foam blocks include individual fabric covers reducing sticking between contacting edges of said blocks in edge-to-edge relationship to maintain a uniform cushioned support surface.

15. The system of claim 14 wherein said foundation assembly includes resilient generally rectangular bolsters surrounding an outside periphery of said foundation blocks to provide foundation support around at least side edges of said mattress base module.

16. An air sleep system having an upper air posturizing module, and a lower base module supporting said posturizing module, said posturizing module comprising:

a pair of adjustable air posturizing sleep surfaces;

first and second individually adjustable air chambers arranged side-by-side in said air posturizing module;

a first individually elevatable posturing section which includes a length of said first air chamber;

a second individually elevatable posturing section which includes a length of said second air chamber;

a third non-elevatable posturing section including a length of each said first and second air chambers;

an operator for moving said first and second posturizing sections individually to a desired inclined position;

whereby individual air posturizing sleep surfaces are provided by first and second upper individually incline adjustable and air adjustable posturizing sections, and a stationary, air adjustable lower posturizing surface.

17. The system of claim 16 wherein said posturizing module includes a resilient overlay disposed on top of said air chambers generally coextending with said air chambers, said resilient overlay having a first overlay section and a second overlay section individually moveable, said first overlay section corresponding to said first moveable posturing section, and said second overlay section corresponding to said second moveable posturing section.

18. The system of claim 16 including a mattress base module supporting said air posturizing module which includes a resilient foam foundation assembly for providing mattress cushioning.

19. The system of claim 18 wherein said mattress base module includes a medial split along a length thereof defining individually elevatable first and second base module sections supporting said first and second module sections of said posturizing module, respectively.

20. The system of claim 19 wherein said operator raises and lowers said first and second moveable sections of said posturizing and base modules individually.

21. The system of claim 20 including a releasable fastener for securing said posturizing and base modules together in use, said fastener including a first fastener part carried by said posturizing module and a second fastener part carried by said base module, said releasable fastener constructed and arranged such that said posturizing and base modules can shift relative to one another while secured together during elevation to reduce bunching.

22. A high-profile air sleep system having a pair of air posturizing sleep surfaces comprising:

an air posturizing module having an outer module mattress case;

a first case section extending medially along a length of said mattress case to define a movable first posturing section;

a second case section extending along a length of said mattress case to define a movable second posturing section, a third case section included in said mattress case defining a third posturing section;

a first air chamber carried in said first and third posuturing sections to provide a first individually elevatable posturizing sleep surface; and a second air chamber carried in said second and third module sections to provide a second individually elevatable posturizing sleep surface.

23. The system of claim 22 wherein said posturizing module includes a resilient overlay disposed on top of said air chambers generally coextending with said air chambers, said resilient overlay having a first overlay section and a second overlay section moveable relative to each other, said first overlay section corresponding to said first posturing section, and said second overlay section corresponding to said second posturing section.

24. The system of claim 23 including a mattress base module having a medial split along a length thereof defining individually elevatable first and second base sections supporting said first and second posturing sections, respectively.

25. The system of claim 24 including a releasable fastener securing said air posturizing module and said base module together, said releasable fastener including a first fastener part carried by said posturizing module and a second fastener part carried by said base module, said releasable fastener constructed and arranged such that said posturizing and base modules can shift relative to one another while secured together during elevation.

26. A high-profile air sleep system having an upper air posturizing sleep surface comprising:

(a) an upper mattress air posturizing module having an adjustable air posturizing sleep surface, said module including:

an air posturizing assembly having first and second individual adjustable air chambers arranged generally side-by-side providing individual adjustable air posturizing sleep surfaces, and a first mattress case encasing said air posturizing assembly;

(b) a mattress base module supporting said air posturizing module which includes:

a resilient foam foundation assembly for providing mattress cushioning, and a second mattress case encasing said foam foundation assembly; and (c) a fastener securing said first and second mattress cases together so that said mattress posturizing module and said mattress base module form and integral mattress structure; whereby said mattress air posturizing module and said mattress base module provide an overall high-profile mattress design with an upper adjustable air posturizing sleep surface.

27. The system of claim 26 wherein said air posturizing assembly includes a resilient overlay disposed on top of said air chambers generally coextending with said air chambers.

28. The system of claim 27 wherein said first mattress case includes a pair of spaced sidewalls integral with a pair of end walls, an upper posturizing cover layer and a posturizing bottom cover layer integral and coextending with said sidewalls and said end walls so that said air chambers and overlay are compactly encased to provide structural mattress stability to said air posturizing whereby sidewall sagging is eliminated.

29. The system of claim 28 wherein said second mattress case includes a pair of spaced sidewalls and integral end walls, an upper base cover layer and a bottom base cover layer integral and coextending with said side walls and end walls so that said foundation assembly is encased to provide structural mattress stability to said base module whereby sidewall sagging is eliminated.

30. The system of claim 26 wherein said fastener includes a releasable fastener securing said first mattress case and said second mattress case together.

31. The system of claim 26 wherein said foundation assembly includes a plurality of individual resilient foam blocks positioned edge-to-edge and encased in said first mattress case.

32. The system of claim 26 including a closable access opening in said first mattress case providing access to an interior of said mattress case and said air chamber.

* * * * *